United States Patent [19]

Aldinger et al.

[11] 4,339,644

[45] Jul. 13, 1982

[54] LOW-POWER ELECTRIC CONTACT

[75] Inventors: Fritz Aldinger; Elke Biberbach, both of Rodenbach; Albrecht Bischoff, Bruchköbel, all of Fed. Rep. of Germany; Nils Harmsen, Garden City, N.Y.

[73] Assignee: W. C. Heraeus GmbH, Hanau, Fed. Rep. of Germany

[21] Appl. No.: 193,178

[22] Filed: Oct. 1, 1980

[30] Foreign Application Priority Data

Oct. 8, 1979 [DE] Fed. Rep. of Germany ..... 2940772

[51] Int. Cl.[3] ..... H01H 1/02

[52] U.S. Cl. ..... 200/266; 200/269

[58] Field of Search ..... 200/266, 262, 267, 269, 200/270

[56] References Cited

U.S. PATENT DOCUMENTS

| | | | |
|---|---|---|---|
| 2,400,003 | 5/1946 | Hensel et al. | 200/262 |
| 2,793,273 | 5/1957 | Underwood et al. | 200/263 |
| 4,050,930 | 9/1977 | Motoyoshi et al. | 200/266 |
| 4,053,728 | 10/1977 | Talento et al. | 200/267 |
| 4,069,370 | 1/1978 | Harmsen et al. | 200/268 |
| 4,111,690 | 10/1978 | Harmsen et al. | 200/266 |
| 4,138,604 | 2/1979 | Harmsen et al. | 200/267 |

FOREIGN PATENT DOCUMENTS

| | | |
|---|---|---|
| 1078774 | 3/1960 | Fed. Rep. of Germany . |
| 2354045 | 5/1975 | Fed. Rep. of Germany . |
| 2540956 | 6/1978 | Fed. Rep. of Germany . |
| 2637807 | 7/1978 | Fed. Rep. of Germany . |
| 2800436 | 12/1979 | Fed. Rep. of Germany . |

OTHER PUBLICATIONS

A. Keil, Materials for Electrical Contacts, 1960, pp. 136–142.

*Primary Examiner*—Willis Little

*Attorney, Agent, or Firm*—Frishauf, Holtz, Goodman & Woodward

[57] ABSTRACT

A low-power electrical contact particularly suitable for switching and plug-in connections. The contact comprises an outer contact layer and a substrate composed of a copper base alloy. The contact layer consists essentially of an alloy of 35–55% by weight gold, 18–33.5% silver, 30–40% palladium, and (i) 1–6% indium, or (ii) 0.5–2% tin together with 0.5–2% indium. An intermediate layer of nickel or copper-nickel may be interposed between the contact layer and the substrate.

15 Claims, 1 Drawing Figure

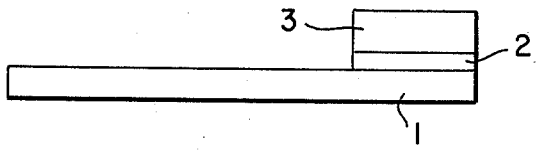
3
2
1

LOW-POWER ELECTRIC CONTACT

BACKGROUND OF THE INVENTION

The present invention provides low-power electric contacts, particularly contacts for switching and plug-in connection, which are made of a composite material comprising a base material and an outer contact layer of precious metals.

Electrical contacts, and particularly those having to meet the rigorous requirements involved in switching applications and plug-in applications, generally utilize noble metals or alloys of noble metals as the contact layer which is clad onto a substrate or base which is not made of noble metals. The base or substrate metals are usually copper alloys, for example, copper-tin, copper-zinc, copper-zinc-nickel, copper-tin-nickel, and copper-beryllium. Nickel and iron alloys are also used as the base material for contacts.

In the manufacture of such composite materials, the outer contact layer and the substrate material are selected from alloys which have properties and characteristics essential to the basic production methods which are sufficiently close to each other so that during processing and also service, the thermal and mechanical stresses do not crack the contact or cause separation between the contact layer and the substrate, instead, leaving them solidly bound to each other.

German Pat. No. 10 89 491 discloses a contact layer for low-power contacts particularly suitable in telecommunication technology having a contact layer of an alloy comprising 25–35% palladium, 35–45% silver, and 25–35% gold.

Alloys for electric contacts which contain palladium, silver and gold as the principal components, are also disclosed to contain indium and tin, together with additional components; see, for example, German Pat. No. 25 40 956 (corresponding to U.S. Pat. No. 4,069,370) disclosing an alloy containing 20–30% by weight palladium, 15–25% silver, 2.5–5% tin, 0.05–0.5% iridium, 0.05–0.5% ruthenium, 0.05–0.5% copper, 0.1–2% indium, and the balance gold; and German Pat. No. 26 37 807 (corresponding to U.S. Pat. No. 4,111,690) disclosing an alloy containing 10–40% silver, 2–25% palladium, 1–5% nickel, 0.1–10% indium, 0.1–3% tin, and the balance gold.

It is an object of the present invention to provide a low-power electric contact particularly suitable for switching and plug-in connections which has improved mechanical and electrical characteristics as a contact, together with a strong bond strength between the contact layer and the substrate.

THE INVENTION

The present invention provides a low-power electrical contact comprising an outer contact layer integrally bonded to a copper-base alloy substrate, said outer contact layer consisting essentially of 35–55% by weight gold, 18–33.5% silver, 30–40% palladium, and (i) 1–6% indium, or (ii) 0.5–2% tin together with 0.5–2% indium.

BRIEF DESCRIPTION OF THE DRAWING

The drawing depicts a cross-section or side view of a low-power contact switch.

DETAILED DESCRIPTION OF THE INVENTION

The following four specified alloy contact layers have proven particularly suitable as the contact layer in the present invention:

39% by weight gold, 22% silver, 37% palladium, and 2% indium;

39% by weight gold, 20% silver, 37% palladium, and 4% indium;

39% by weight gold, 22.5% silver, 37% palladium, 1% tin, and 0.5% indium; and

39% by weight gold, 29.5% silver, 30% palladium, 1% tin, and 0.5% indium.

The self-hardening copper alloys have proven suitable as the substrate material, including the self-hardening copper alloys disclosed hereinbefore. The preferred substrate materials are copper-tin alloys containing 6 to 8% by weight of tin. Composite materials containing the four specific contact alloy layers disclosed as being particularly suitable in the present invention integral with a substrate copper alloy containing 6% tin or a substrate copper alloy containing 8% tin are preferred embodiments of the present invention when formed as a low-power electric contact.

Tests have determined that when the low-power electrical contacts of the present invention are exposed to atmospheric contamination, they continue to exhibit very good electrical conductivity and to exhibit very good wear and corrosion resistance during prolonged testing.

The low-power contacts of the present invention are suitably formed into the desired composite material by roll-bonding a strip of the contact material together with the base metal substrate, followed by forming operations, for example, bending. During such manufacturing operations with the materials specified in the low-power electrical contacts of the present invention, an excellent solid bond is formed between the contact material and the substrate and therefore provides a particular advantage of the composite contact material-substrate utilized in the present invention. Long strips thereof may be obtained by roll-bond cladding without processing difficulties. Leaf springs which are made of this composite material do not exhibit bending cracks.

The copper alloys containing tin in an amount of 6% and 8% which are preferred as the substrate materials have characteristics which exhibit good matching of the recrystallization temperature thereof (of the substrate material) and the contact layer material, resulting in good adhesion between them.

In a further preferred embodiment of the present invention, an intermediate coating of nickel or copper-nickel is provided between the outer contact layer and the substrate to prevent diffusion between the contact layer and the substrate. This intermediate coating of nickel or copper-nickel may be deposited on one or both of the other materials before the two are formed into an integral unit, or may even be provided as a very thin layer and the three materials roll-bonded together to form a composite with the very thin intermediate layer of nickel or copper-nickel.

The drawing illustrates a low-power switching contact in accordance with the present invention. The substrate 1, an intermediate layer of nickel or copper-nickel functioning as a diffusion barrier 2, and the outer contact layer 3 form an integral composite material, which when formed using the contact layer alloys and the substrate alloys specified in the present invention, provide an excellent low-power electrical contact.

The preferred alloy contact layers contain 20–29.5% silver, 30–37% palladium, (i) 2–4% indium, or (ii) 0.5–1% tin together with 0.5–1% indium and gold as residue.

What is claimed is:

1. A low-power electrical contact comprising an outer contact layer integrally bonded to a substrate, said substrate comprising a copper-base alloy, and said contact layer consists essentially of 39% gold, 22% silver, 37% palladium, and 2% indium.

2. A low-power electrical contact comprising an outer contact layer integrally bonded to a substrate, said substrate comprising a copper-base alloy, and said contact layer consists essentially of 39% gold, 20% silver, 37% palladium, and 4% indium.

3. A low-power electrical contact comprising an outer contact layer integrally bonded to a substrate, said substrate comprising a copper-base alloy, and said contact layer consists essentially of 39% gold, 22.5% silver, 30% palladium, 1% tin, and 0.5% indium.

4. A low-power electrical contact comprising an outer contact layer integrally bonded to a substrate, said substrate comprising a copper-base alloy, and said contact layer consists essentially of 39% gold, 29.5% silver, 30% palladium, 1% tin, and 0.5% indium.

5. The contact of any one of claims 1 through 4, wherein said substrate comprises between 6% and 8% by weight tin and the balance essentially copper.

6. The contact of claim 5, wherein said substrate consists essentially of 94% copper and 6% tin.

7. The contact of claim 5, wherein said substrate consists essentially of 92% copper and 8% tin.

8. The contact of any one of claims 1 through 4, wherein said contact comprises said outer contact layer integral with an intermediate layer of nickel or copper-nickel and said substrate, forming an integral composite of said three layers.

9. The contact of claim 5, wherein said contact comprises said outer contact layer integral with an intermediate layer of nickel or copper-nickel and said substrate, forming an integral composite of said three layers.

10. The contact of claim 6, wherein said contact comprises said outer contact layer integral with an intermediate layer of nickel or copper-nickel and said substrate, forming an integral composite of said three layers.

11. The contact of claim 7, wherein said contact comprises said outer contact layer integral with an intermediate layer of nickel or copper-nickel and said substrate, forming an integral composite of said three layers.

12. A low-power electrical contact comprising an outer contact layer integrally bonded to a substrate, said substrate comprises between 6% and 8% by weight tin and the balance essentially copper, and said contact layer consisting essentially of 35–55% by weight gold, 18–33.5% silver, 30–40% palladium, and (i) 1–6% indium, or (ii) 0.5–2% tin together with 0.5–2% indium.

13. The contact of claim 12, wherein said contact comprises said outer contact layer integral with an intermediate layer of nickel or copper-nickel and said substrate, forming an integral composite of said three layers.

14. A low-power electrical contact comprising an integral composite of three layers bonded together, said composite comprising an outer contact layer integral with an intermediate layer of nickel or copper-nickel and said intermediate layer integral with said outer contact layer and with a substrate, said substrate comprising a copper-base alloy, and said contact layer consisting essentially of 35–55% by weight gold, 18–33.5% silver, 30–40% palladium, and (i) 1–6% indium, or (ii) 0.5–2% tin together with 0.5–2% indium.

15. A low-power electrical contact comprising an integral composite of three layers bonded together, said composite comprising an outer contact layer integral with an intermediate layer of nickel or copper-nickel and said intermediate layer integral with said outer contact layer and with a substrate, said substrate comprising a copper-base alloy, and said contact layer consisting essentially of 20–29.5% by weight silver, 30–37% palladium, and (i) 2–4% indium, or (ii) 0.5–1% tin together with 0.5–1% indium, and the balance gold.

* * * * *